United States Patent [19]

Miller

[11] Patent Number: 4,733,862

[45] Date of Patent: Mar. 29, 1988

[54] ELASTIC RESISTANCE EXERCISER

[76] Inventor: Jack V. Miller, 700 N. Auburn Ave., Sierra Madre, Calif. 91024

[21] Appl. No.: 40,095

[22] Filed: Apr. 20, 1987

[51] Int. Cl.[4] ..... A63B 21/02

[52] U.S. Cl. ..... 272/137; 272/136; 24/129 R

[58] Field of Search ..... 272/135–138, 272/DIG. 4; 24/115 H, 115 K, 129 R, 129 D, 130; 182/5

[56] References Cited

U.S. PATENT DOCUMENTS

| | | | |
|---|---|---|---|
| 59,277 | 10/1866 | Sawyer | 24/129 R |
| 1,524,108 | 1/1925 | Roland | 24/129 R |
| 3,677,543 | 7/1972 | Richardson | 272/136 |
| 4,019,734 | 4/1977 | Lee et al. | 272/137 |

*Primary Examiner*—Richard J. Apley
*Assistant Examiner*—J. Welsh

[57] ABSTRACT

An elastic resistance exerciser comprises an an elongated elastic member having a loop formed at each end, a tubular handle slidably fit onto each loop of the elastic member, and a self-locking slider having three holes; with the elastic member slidably threaded through two of the holes and terminating the end of each loop in the third hole of each slider; the slider being adjustable along the elastic member, whereby the size of the loop may be varied by moving the slider with no tension on the loop, but self-locking by the application of tension to the loop. A preferred embodiment provides a band of flexible material attached approximately to the center of the length of an elastic member having more than one elastic element.

7 Claims, 11 Drawing Figures

ELASTIC RESISTANCE EXERCISER

BACKGROUND OF THE INVENTION

There are a number of elastic resistance exercise devices that have been manufactured for many years, and sold in large numbers. These prior art devices have two major functional problems. The first problem is the inability to easily adjust the length of the elastic member; and presently known devices are either not adjustable at all, or they shorten the length of the elastic by wrapping turns of it around a central bar or around a part of the user's body. The second problem is the inherent hazard in potential breakage of the elastic member under stress. Since the elongation of rubber or metal springs may exceed 600% at the stress limit, a broken end of the elastic may accelerate instantaneously, and fly back to injure the user or an observer.

SUMMARY OF THE INVENTION

A primary purpose of the present invention is to provide an elastic resistance exerciser that has an easy and positive means for adjustment to accomodate different exercises and user sizes. Another purpose of the invention is to provide an elastic member that is restrained by a secondary tension member that precludes the release and flyback of the end of a broken elastic member under stress. It is a further purpose of the present invention to provide an elastic exerciser of very low cost, without sacrificing functional versatility or safety.

In order to achieve the foregoing purposes, the present invention provides an elastic resistance exerciser including an an elongated elastic member having both primary and secondary load carrying elements, wherein breakage of either load carrying element cannot cause catastrophic failure of the elastic member. One such dual elastic member that has proven to be very safe and effective is made of shock cord having a stranded elastic core surrounded by a braided stretchable fabric sheath. Another dual elastic member is a rubber tube coaxially disposed within another larger diameter rubber tube. A third dual elastic member was found to be a rubber cord coaxially disposed with a rubber tube.

The elastic member has a loop formed at each end, a tubular handle threaded onto each loop of the elastic member, and a slider terminating the end of each loop and adjustable along the elastic member. The slider is movable only when the elastic member is not in tension, whereby the size of either loop may be varied; and locks when a tension load is applied to the elastic member, whereby the loop size is fixed. A preferred embodiment includes a band of flexible inelastic material attached approximately at the center of the length of the elastic member; providing an optional increased length of the exerciser, and easy attaching to a fixed object used as an anchor point for exercise.

DETAILED DESCRIPTION OF THE DRAWINGS

Figure 1:
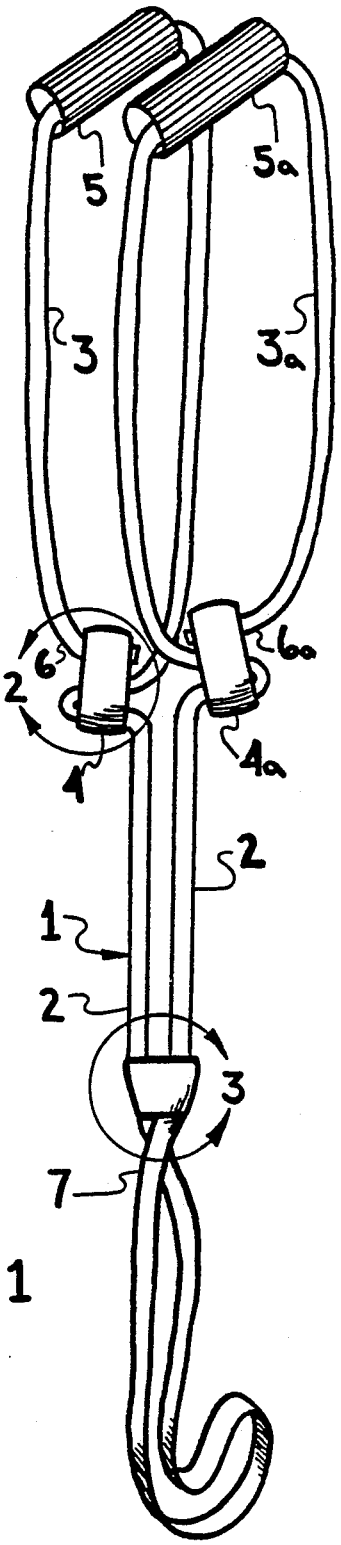
FIG. 1 shows a plan view of an elastic exerciser according to the invention.

In FIG. 1 the elastic resistance exerciser 1 is shown having an elongated elastic member 2. A loop 3 is formed at each end of elastic member 2 by passing elastic member 2 through a slider 4, passing elastic member 3 though a tubular handle 5 and then anchoring end 6 into block 4. Similarly, loop **3*a* is formed at each end of elastic member 2 by passing elastic member 2 through a slider 4*a*, passing elastic member 2 though a tubular handle 5*a* and then anchoring end 6*a* into block 4*a*. At approximately the midpoint of elastic member 2 a flexible inelastic band 7** is attached.

Figure 2:
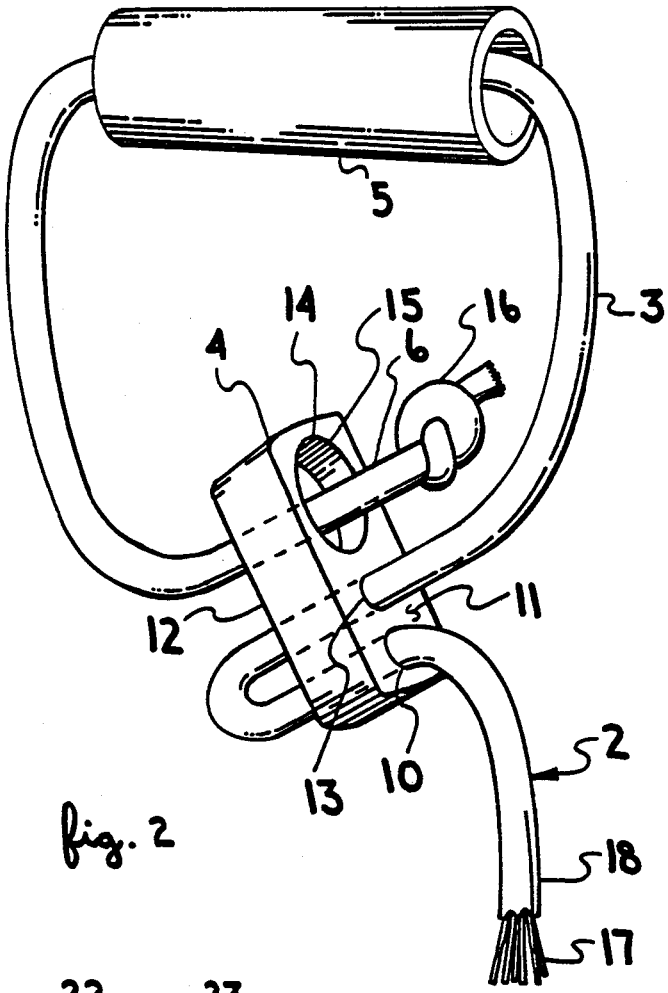
FIG. 2 is a perspective view of the portion of the exerciser of FIG. 1, shown in detail 2.

In FIG. 2 loop 3 is shown in detail having elastic member 2 passing slidably through a first hole 10, entering a first side 11 and exiting a second side 12 of slider 4. Elastic member 2 is then bent back to pass slidably through a second hole 13 from second side 12 to first side 11 of slider 4. Elastic member 2 is then passed through a tubular handle 5 and is formed into a loop 3 by again entering side 12 of slider 4, to pass through a third hole 14 having a counterbore 15. End 6 of elastic member 2 is then provided with an enlargment 16 which precludes withdrawal back through hole 14. One preferred configuration for the elastic member 2 is shown as a shock cord having a plurality of elastic strands 17, encased by a stretchable fabric sheath 18.

Figure 3:
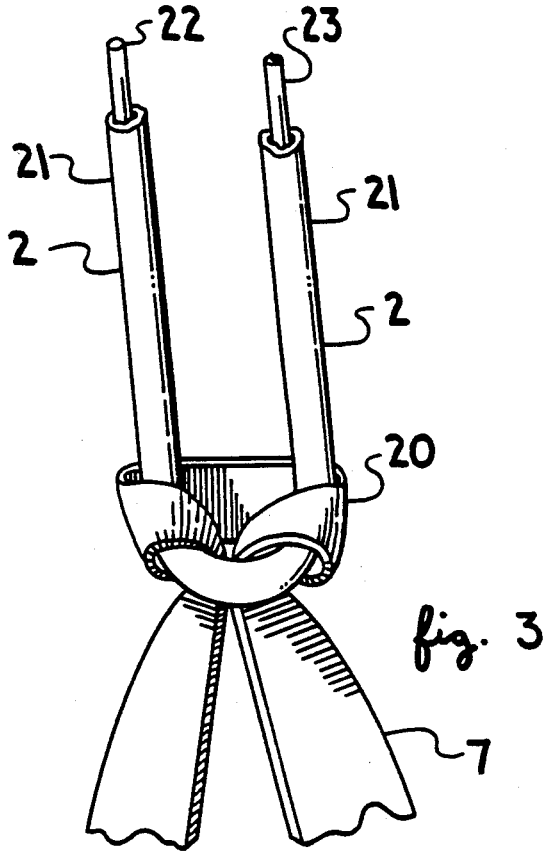
FIG. 3 is a perspective view of the portion of the exerciser of FIG. 1, shown in detail 3.

In FIG. 3 the elastic member 2 is shown in detail at its attachment to the flexible inelastic band 7. Band 7 is a continuous elongated band of flexible strap material, typical of commercially available flat webbing. One simple attachment means is shown as a sheet-bend knot 20. An alternate preferred configuration for the elastic member 2 is shown having an outer rubber tube 21, having either a rubber cord 22 or tube 23 coaxially disposed within the outer tube 21.

Figure 4:
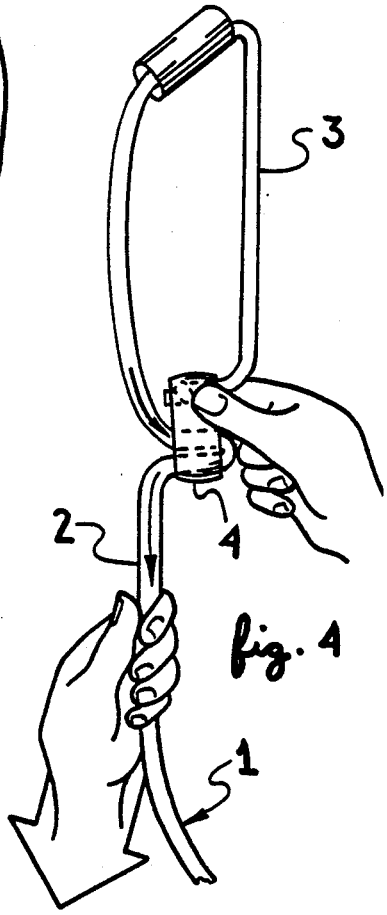
FIG. 4 is a perspective view of a portion of the exerciser of FIG. 1, being adjusted to have smaller handle loops.

In FIG. 4 a user is shown adjusting the loops 3 of the exerciser 1 to a relatively smaller size. The loop 3 size may be made smaller as shown only by holding slider block 4 and pulling on elastic member 2, with no tension on loop 3. Pulling on the elastic member 2 elongates the elastic material. As is well known, elongating any structural material in tension reduces its cross section. Therefore pulling on the elastic member 2 as shown slightly reduces its diameter within the holes in block 4, and permits the slider block to move easily along the elastic member to change the loop size. Experiments have shown that an elongation of 5% to 10% in the elastic member usually occurs before the slider block suddenly releases and moves. Any tension applied to loop 3 while elastic member 2 is also under tension instantly causes the slider block to automatically lock onto the elastic member 2, thereby providing a self-locking function for the adjustable loops.

Figure 5:
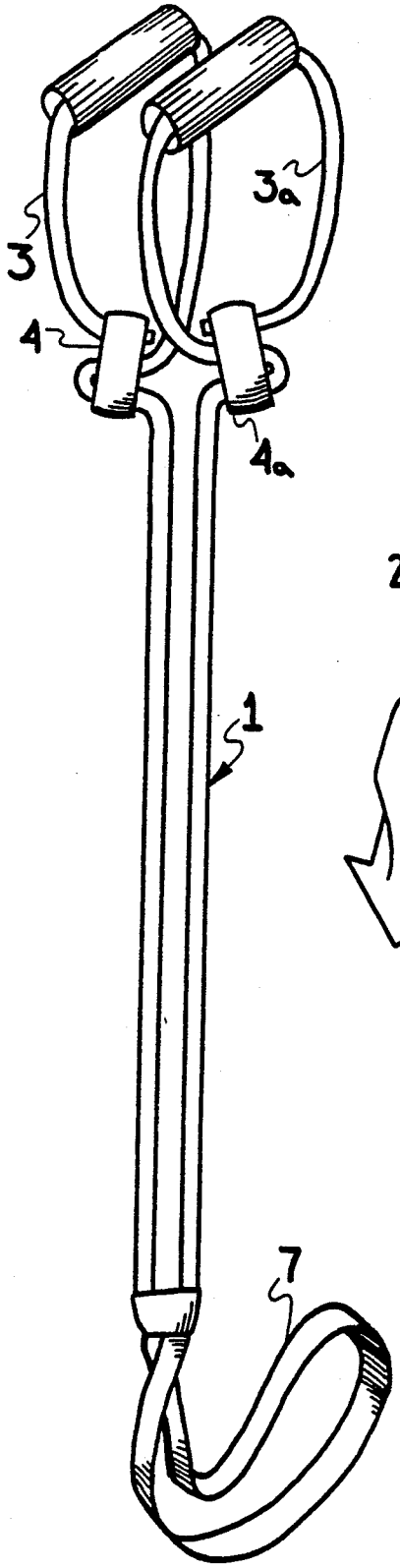
FIG. 5 is a plan view of the exerciser of FIG. 1, after being adjusted to have smaller handles.

FIG. 5 shows exerciser 1 with both loops 3 and 3*a*, respectively, adjusted to a small size, making the effective working length of the elastic member 2 longer.

Figure 6:
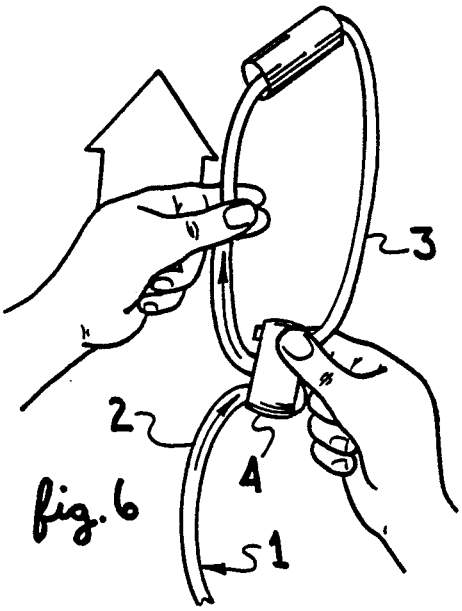
FIG. 6 is a perspective view of a portion of the exerciser of FIG. 1, being adjusted to have larger handle loops.

In FIG. 6 a user is shown adjusting the loops 3 of the exerciser 1 to a relatively larger size. The loop 3 size may be made large as shown only by holding slider block 4 and pulling on the side of loop 3, with no tension on elastic member 2. Any tension applied to loop 3 while elastic member 2 is also under tension instantly causes the slider block to automatically lock onto the elastic member 2, thereby providing a self-locking function for the adjustable loops.

Figure 7:
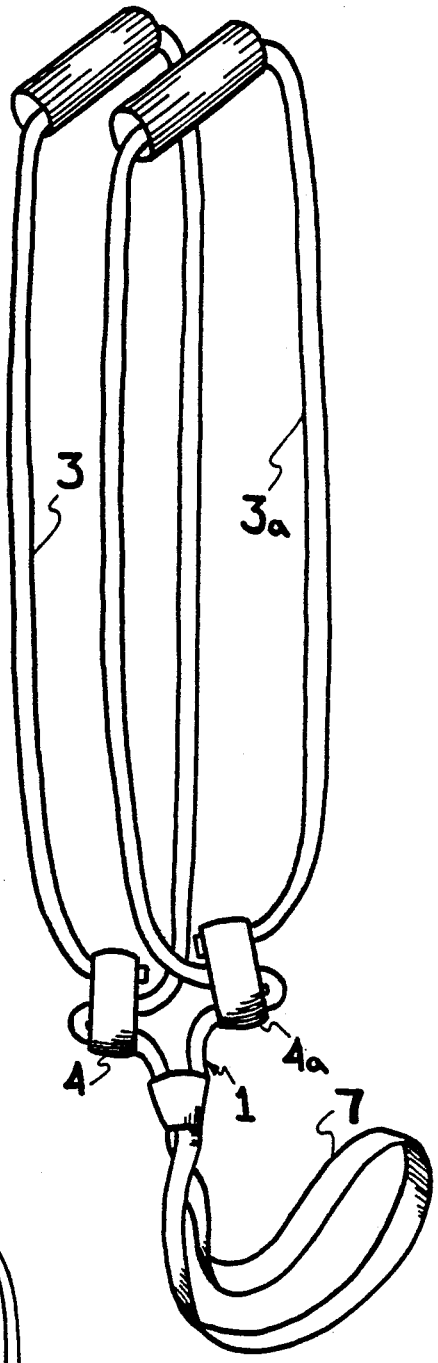
FIG. 7 is a plan view of the exerciser of FIG. 1, after being adjusted to have larger handles.

FIG. 7 shows exerciser 1 with both loops 3 and 3*a*, respectively, adjusted to a larger size, making the effective working length of the elastic member 2 shorter.

Figure 8:
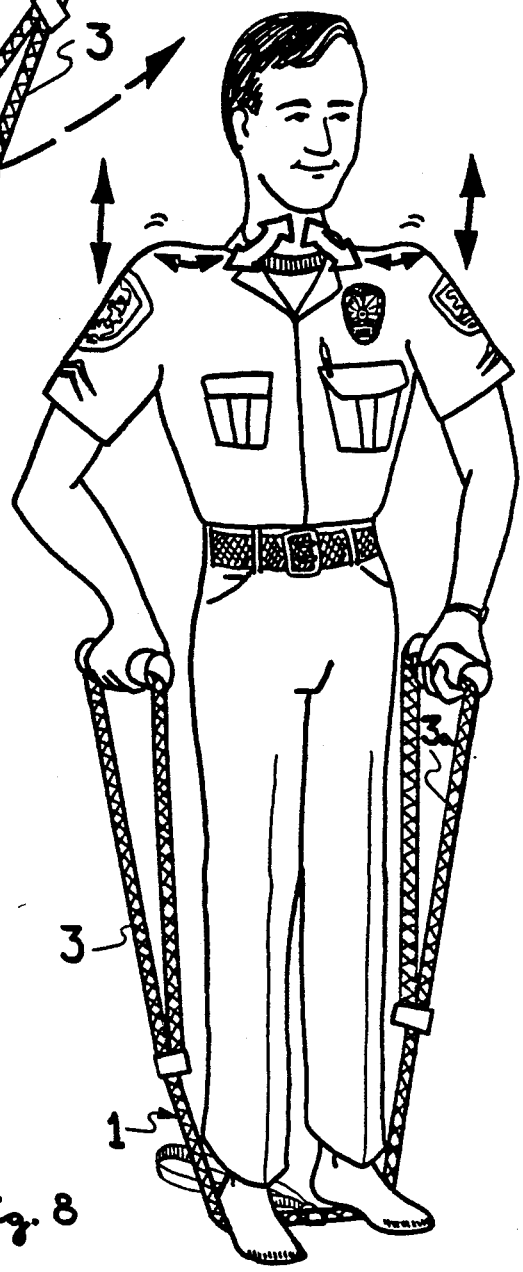
FIG. 8 is a perspective view of the exerciser of FIG. 7 in a typical standing use.

FIG. 8 shows the exerciser 1, as adjusted according to FIG. 7, in use in a shoulder shrug exercise.

Figure 9:
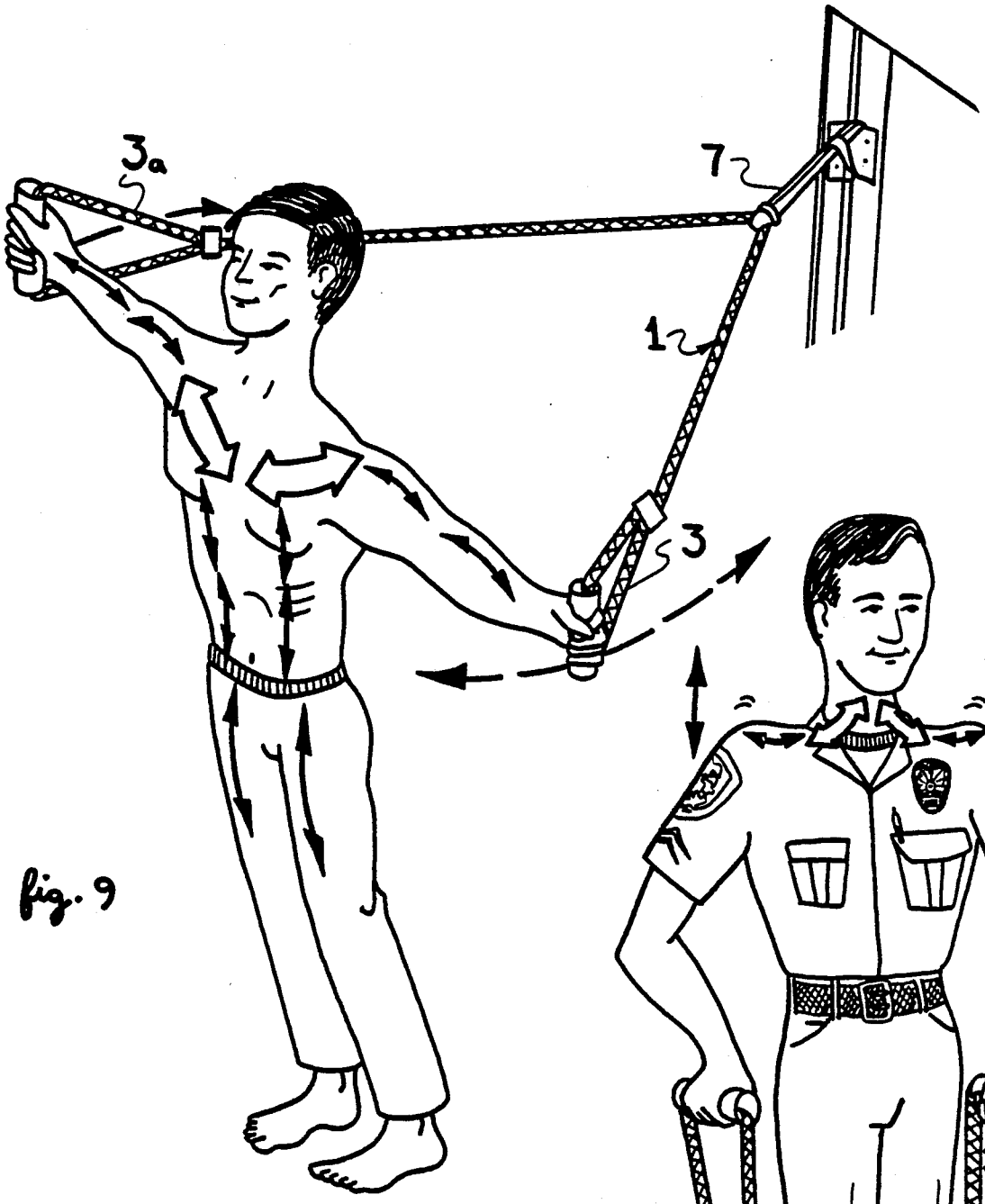
FIG. 9 is a perspective view of the exerciser of FIG. 5 in a typical use attached to a doorway hinge.

FIG. 9 shows the exerciser 1, as adjusted in accordance with FIG. 5, in use in a pectoral muscle exercise, with band 7 looped around the hinge of a door.

Figure 10:
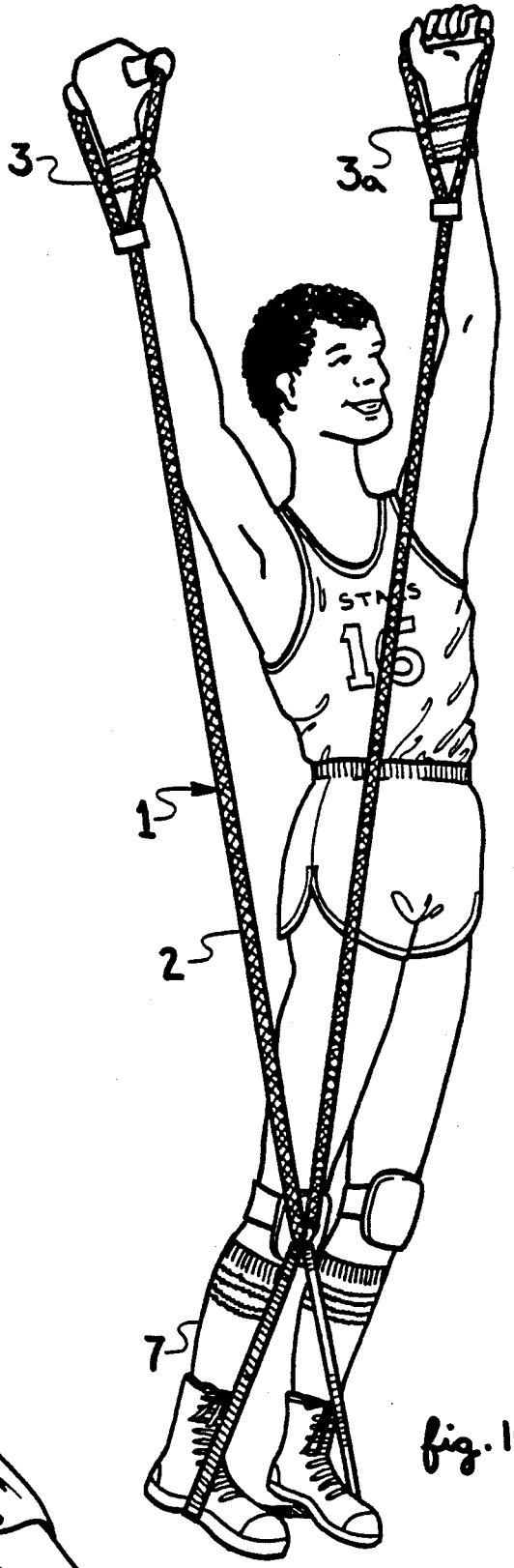
FIG. 10 is a perspective view of the exerciser of FIG. 5 in a typical standing use by a tall user.

FIG. 10 shows the exerciser 1, as adjusted in accordance with FIG. 5, in use in a military press exericse, with band 7 looped around the feet of a very tall user, further extending the length of the exerciser.

Figure 11:
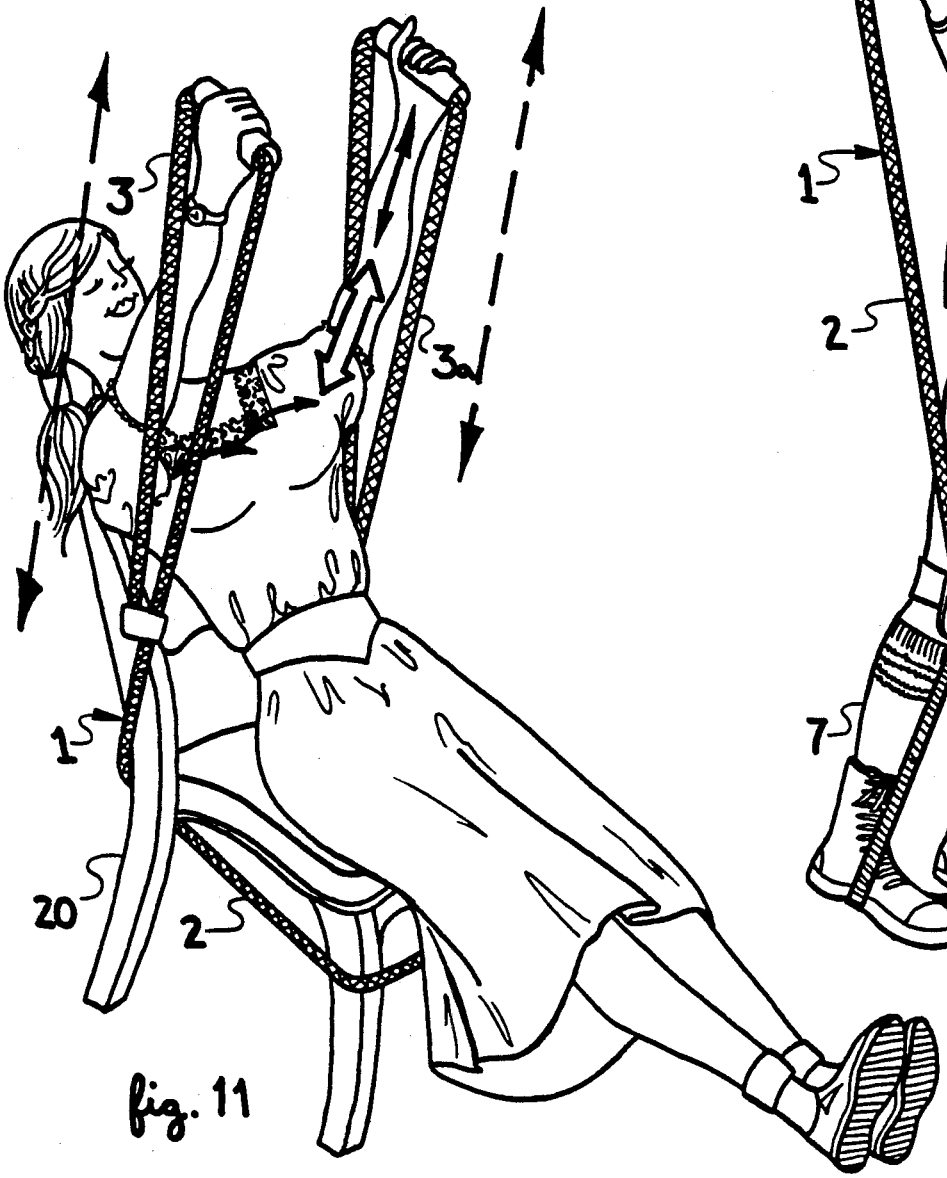
FIG. 11 is a perspective view of the exerciser of FIG. 1 in a typical seated use.

FIG. 11 shows the exerciser 1, as adjusted in accordance with FIG. 7, in use in a bench press exercise, with the elastic member 2 looped around a chair. By adjustment of the size of loops 3 and 3*a* for the physical size and strength of the user, and in accordance with the desired posture during exercise, a wide variety of several dozen exercises can be performed with the exerciser disclosed herein.

I claim:

1. An elastic resistance exerciser comprising:

an elongated elastic member formed into a loop at each end;

a generally tubular handle threaded onto each loop of the elastic member;

a self-locking size adjusting means, slidable along the elastic member closing each loop, in which each loop size self-locking adjusting means is a block having three holes therethrough; the elastic member passing slidably through a first hole, entering a first side of said block and exiting a second side, then bent back to pass slidably through a second hole from the second side to the first side of the block, then passing through a tubular handle and being formed into a loop by again entering the second side of the block, passing through a third hole, then provided with an enlargment which precludes withdrawal back through the third hole.

2. An elastic resistance exerciser according to claim 1 in which the elongated elastic member is a length of shock cord having a core comprising a plurality of rubber strands and encased in a braided stretchable fabric sheath.

3. An elastic resistance exerciser according to claim 1 in which the elongated elastic member is a length of rubber tubing.

4. An elastic resistance exerciser according to claim 1 in which the elongated elastic member is a length of rubber tubing also having a length of rubber cord coaxially disposed within the rubber tubing.

5. An elastic resistance exerciser according to claim 1 in which the elongated elastic member is a first length of rubber tubing having a second length of rubber tubing coaxially disposed within the first length of rubber tubing.

6. An elastic resistance exerciser according to claim 1 in which the anchoring means is an enlargement of the ends of the elastic member to a size larger than the respective hole.

7. An elastic resistance exerciser according to claim 1 in which an elongated band of flexible inelastic material is attached approximately at the center of the length of the elongated elastic member.

* * * * *